US008778076B2

(12) United States Patent
Haanepen et al.

(10) Patent No.: US 8,778,076 B2
(45) Date of Patent: Jul. 15, 2014

(54) FOUNDRY COATING COMPOSITION

(75) Inventors: Martinus Jacobus Haanepen, Didam (NL); Frederik Willem Von Piekartz, Enschede (NL)

(73) Assignee: Foseco International Limited, Derbyshire (GB)

( * ) Notice: Subject to any disclaimer, the term of this patent is extended or adjusted under 35 U.S.C. 154(b) by 175 days.

(21) Appl. No.: 13/322,836

(22) PCT Filed: Feb. 15, 2011

(86) PCT No.: PCT/GB2011/000192

§ 371 (c)(1),
(2), (4) Date: Jun. 20, 2012

(87) PCT Pub. No.: WO2011/110798

PCT Pub. Date: Sep. 15, 2011

(65) Prior Publication Data

US 2013/0032689 A1 Feb. 7, 2013

(30) Foreign Application Priority Data

Mar. 8, 2010 (EP) ..... 10250423

(51) Int. Cl.

| | |
|---|---|
| ***B22C 3/00*** | (2006.01) |
| ***B28B 7/36*** | (2006.01) |
| ***B28B 7/00*** | (2006.01) |
| ***B22C 9/00*** | (2006.01) |
| ***B28B 1/30*** | (2006.01) |

(52) U.S. Cl.

CPC ... *B22C 3/00* (2013.01); *B28B 7/36* (2013.01); *B28B 7/00* (2013.01); *B22C 9/00* (2013.01); *B28B 1/30* (2013.01)

USPC ..... 106/38.27; 106/38.2; 106/38.22; 106/38.28; 106/38.9; 164/72; 249/114.1

(58) Field of Classification Search

CPC ..... B22C 3/00; B22C 9/00; B28B 1/30; B28B 7/00; B28B 7/36; B28B 2007/00

USPC ..... 106/38.2, 38.22, 38.27, 38.28, 38.9; 164/72; 249/114.1

See application file for complete search history.

(56) References Cited

U.S. PATENT DOCUMENTS

| | | | | | |
|---|---|---|---|---|---|
| 3,490,135 | A | | 1/1970 | Stein | |
| 3,993,597 | A | * | 11/1976 | Stiles | 502/2 |
| 5,573,580 | A | | 11/1996 | Bartsch et al. | |

FOREIGN PATENT DOCUMENTS

| | | | | | |
|---|---|---|---|---|---|
| CN | 1109678 | A | | 10/1995 | |
| CN | 1478621 | A | | 6/2003 | |
| GB | 712016 | | | 7/1954 | |
| JP | 6-190498 | | | 7/1994 | |
| JP | 2003-3191048 | A | | 7/2003 | |
| JP | 2003191048 | A | * | 7/2003 | B22C 9/10 |
| WO | WO 94/26440 | A1 | | 11/1994 | |

OTHER PUBLICATIONS

Mexican Office Action dated Feb. 25, 2014, issued in Mexican Patent Application No. MX/a/2011/013937 (6 pgs).

Chinese Office Action dated Feb. 14, 2014, issued in Chinese PCT National Phase Patent Appln. No. 201180012745.4, based on PCT/GB2011/000192, filed Feb. 15, 2011 (12 pgs).

* cited by examiner

*Primary Examiner* — Anthony J Green

(74) *Attorney, Agent, or Firm* — Nixon & Vanderhye, P.C.

(57) ABSTRACT

A foundry coating composition for molds and cores, a process for preparing coated foundry molds and cores, and coated molds and cores obtainable by the process. The foundry coating composition comprises a liquid carrier; a binder; and a particulate refractory filler. The particulate refractory filler comprises a first (relatively coarse) fraction having a particle size of d>38 μm and a second (relatively fine) fraction having a particle size of d<38 μm. No more than 10% of the total particulate refractory filler has a particle size of 38 μm<d<53 μm and no more than 50% of the second (relatively fine) fraction is constituted by calcined kaolin. The foundry coating composition is applied to molds and cores to assist in the removal of the casting from the mold and prevention of casting defects. The composition is applied to molds and cores in a single step to obtain molds and cores having a surface coating (comprising particles of d>38 μm) and an absorbed coating (comprising particles of d<38 μm).

13 Claims, 9 Drawing Sheets

FOUNDRY COATING COMPOSITION

This application is the U.S. national phase of International Application No. PCT/GB2011/000192 filed 15 Feb. 2011 which designated the U.S. and claims priority to European Application No. 10250423.0 filed 8 Mar. 2010, the entire contents of each of which are hereby incorporated by reference.

The present invention relates to a foundry coating composition, in particular a coating composition for moulds and cores, a process for coating moulds and cores, and moulds and cores obtainable by the process.

Metal shapes are cast by pouring molten metal into a cavity defined by a mould and optionally a core. The foundry shape that defines the exterior of the cast part is known as a foundry mould and the foundry shape that defines the interior of the cast part is known as a core. When liquid metal is cast into a sand mould, against a core, there is a physical effect and a chemical reaction at the sand/metal interface. Either may result in surface defects on the finished casting.

Metal penetration and cracking are physical casting defects that arise in the sand mould and core. Penetration defects occur when liquid metal enters the pores of the sand mould or core giving a rough surface to the casting. Cracking may occur as a result of differential thermal expansion of the sand. Silica sand is particularly prone to cracking because of a strong expansion that takes place at 573° C. as a result of a phase change. When the hot metal hits the cold mould or core surface a strong thermal gradient arises, with heat dissipating into the core by diffusion. The outer layer of the mould or core reaches the 573° C. first, causing a compressive force due to the sudden expansion. The deeper layers (away from the hot metal) reach 573° C. later, and when these layers expand the compressive force at the surface turns in a tensile force and cracking may occur. Liquid metal at the mould or core surface may then enter the crack, resulting in a raised streak or vein being formed on the casting surface.

Chemical defects include sand burn-on and carbonaceous defects. Sand burn-on may result from the presence of impurities in the sand (particularly alkali metal salts) that reduce the refractoriness of the mould or core. Carbonaceous defects occur when organic mould and core binders degrade at the high metal pouring temperatures, forming carbon bearing gases which can lead to carbon pick-up or surface pock marks due to lustrous carbon.

A wide variety of different agents have been added to moulding sand in an attempt to improve the properties of the moulds and cores to avoid veining and other defects. These additives (anti-veining agents) include starch based products, dextrin, iron oxide (including red and black iron oxide) and alkaline earth or alkaline metal fluorides. Typically the additives are blended with resin and sand before manufacturing the mould or core. The additive is evenly distributed throughout the whole mould or core. Disadvantages of this are that relatively large quantities of (relatively expensive) additive have to be used and it is usually necessary to increase the level of binder to maintain sufficient core strength.

Refractory coatings (also known as mould paints, dressings or washes) have also been used for many years to improve the properties of the resulting casting. The aims of the coatings include providing a smooth casting finish, protecting the sand from the molten metal to limit sand burn-on and metal penetration, insulating moulds and cores against cracking and veining and providing easier removal of sand from the casting surface. The coatings are commonly based on graphite, aluminosilicates (talc, mica, pyrophillite) or zircon silicate refractories.

Multiple layers of refractory coatings may be applied to cores and moulds to reduce defects and improve casting quality. WO89/09106 describes a sand core that is first dipped or sprayed with an aqueous suspension comprising a first refractory coating containing finely ground fused silica. The coating is dried and then a second soft release coating (e.g. a suspension of powdered graphite) is applied. JP2003191048A discloses a sand core having first and second coating layers. The first coating layer (14) permeates the core and is constituted by zircon flour and an organic binder. The second layer (16) contains mica as lubricant to aid removal of the casting. The second coating layer is applied after the first coating layer.

According to a first aspect of the present invention there is provided a foundry coating composition comprising a liquid carrier;

a binder;

and a particulate refractory filler;

the particulate refractory filler comprising a first (relatively coarse) fraction having a particle size of $d>38$ μm and a second (relatively fine) fraction having a particle size of $d<38$ μm, wherein no more than 10% of the total particulate refractory filler has a particle size of 38 μm$<d<$53 μm and from 0 to 50% of the second (relatively fine) fraction is constituted by calcined kaolin.

FIG. 1 is a schematic drawing of part of a foundry mould or core that has been coated with the composition of the invention. The foundry mould or core is made from grains of sand 10. The grains of sand 10 are bonded to one another by a binder (not shown) to produce the desired shape. The foundry mould or core is porous; there are spaces (pores) 12 between the grains of sand 10. When the coating composition is applied to the foundry mould or core, the second (relatively fine) fraction 14 permeates the porous foundry mould or core to a certain depth (indicated by Y in FIG. 1). The first (relatively coarse) fraction 16 has a particle size that it too large to permeate the foundry mould or core and instead forms a surface layer 16.

Without wishing to be bound by theory, the inventors propose that the first (relatively coarse) fraction allows easy release of the casting from the sand core or mould, whilst the second (relatively fine) fraction helps to prevent veining defects.

Furthermore, the inventors have shown that the benefits of the coating composition are reduced when the coating composition comprises a high proportion of calcined kaolin (calcined clay).

The coating composition may be applied in a single step to a foundry mould or core to provide the absorbed layer (comprising the second (relatively fine) fraction) that permeates the mould or core and the surface layer (comprising the first (relatively coarse) fraction) that laminates the mould or core. The single step is advantageous as compared to prior art processes where two separate coatings are applied, in particular where a first coating is dried before a second coating is applied.

The inventors have discovered that sufficient absorption of fine particles into the mould or core can be achieved in a single step by removing a proportion of the particles having a particle size in the range 38 μm$<d<$53 μm. Particles having a particle size of 38 μm$<d<$53 μm will be referred to herein as the critical fraction. It is proposed that the critical fraction blocks the pores in the sand mould or core and thereby hinders penetration of the fines fraction. The blocking effect has been shown to be substantially independent of the type of sand being used (particle size and shape).

Surprisingly, the coating composition of the present invention may be as effective as two separate coatings comprising a fine fraction and a coarse fraction respectively. Work has shown that satisfactory casting results may be obtained by a dual coating process, whereby an absorption coating containing only the fine particles is first applied, followed by application of a coating containing the coarse fraction, either with or without intermediate drying stage between applications. However, it has been observed that for certain complex cores with cavities (pockets), problems may arise if there has been no intermediate drying of the first absorption coating, the second coating sometimes failing to adhere uniformly in certain areas. An alternative two-step process comprises first applying an absorption liquid coating containing only the fine particles, followed by application of a dry powdered coarse fraction via holding the still wet first coated mould or core in a fluidised bed of the coarse particles so that they adhere to the surface.

The particle size of the first (relatively coarse) fraction and the second (relatively fine) fraction may be determined by sieving. The particulate refractory filler that will pass through a sieve having an aperture size of 38 μm is defined for the purposes of this invention as the second (relatively fine) fraction whilst the particulate refractory filler that is retained by a sieve having an aperture size of 38 μm is the first (relatively coarse) fraction. The sieve may be an ISO 3310-1 standard sieve. The particles having a particle size of 38 μm<d<53 μm will pass through a sieve having an aperture size of 53 μm but will not pass through a sieve having an aperture size of 38 μm.

In one series of the embodiments, no more than 10%, 7%, 4%, 3%, or 1% of the total particulate refractory filler is constituted by particles having a particle size of 38 μm<d<53 μm. Since the critical fraction is shown to hinder absorption, the inventors propose that a lower percentage of critical fraction is beneficial. However, for practical reasons it may be difficult to eliminate the critical fraction entirely. The percentages may be determined by weight (wt %) or by volume (vol %).

In addition, the critical fraction (38 μm<d<53 μm) may be determined relative to the first (relatively coarse) fraction. In one series of the embodiments, no more than 15%, 10%, 8%, 6%, or 3% of the first (relatively coarse) fraction is constituted by particles having a particle size of 38 μm<d<53 μm. The percentages may be determined by weight (wt %) or by volume (vol %).

In one embodiment, the first (relatively coarse) fraction has a particle size of no more than 630 μm, no more than 500 μm, no more than 400 μm, no more than 250 μm or no more than 180 μm.

Generally, coarser/larger (spherical) particles have rougher surfaces i.e the smaller the particle size, the smoother the coating layer. The limitation to the upper size is generally determined by the sharpness of core edges, since cracking of the coating may occur at these edges. Particle morphology is also a factor in determining coating surface properties, since coarse, flake shaped refractory materials typically give a smoother casting surface than equivalent sized round particles flake materials because they are very thin and lie flat onto the surface.

In one embodiment, the second (relatively fine) fraction has a particle size of no more than 35 μm, no more than 30 μm, no more than 25 μm, no more than 20 μm or no more than 10 μm.

The particulate refractory filler comprises a first (relative coarse) fraction having a particle size of d>38 μm and a second (relatively fine) having a particle size of d<38 μm. In one series of embodiments, the ratio of the first (relatively coarse) fraction to the second (relatively fine) fraction is from 0.1 to 2.0:1, from 0.5 to 1.5:1, from 0.8 to 1.2:1, from 1.2 to 0.8:1, from 1.5 to 0.5:1 or from 2.0 to 0.1:1. The ratio may be calculated by weight or by volume.

In another series of embodiments, the ratio of the weight percent (wt %) of the first (relatively coarse) fraction to the weight percent (wt %) of the second (relatively fine) fraction is from 0.1 to 2.0, from 0.2 to 1.7, from 0.3 to 1.4 or from 0.5 to 1.0.

In a further series of embodiments the ratio of the volume percent (vol %) of the first (relatively coarse) fraction to the volume percent (vol %) of the second (relatively fine) fraction is from 0.5 to 2.0, from 0.7 to 1.8 or from 0.9 to 1.5.

The particulate refractory filler is not particularly limited. Suitable refractory fillers include graphite, silicate, aluminosilicate (e.g. molochite), aluminium oxide, zircon silicate, muscovite (mica), illite, attapulgite (palygorskite), pyrophilite, talc, and iron oxide (including red iron oxide and yellow (hydrated) iron oxide).

In one embodiment the first (relatively coarse) fraction comprises one or more of graphite, silicate, aluminosilicate (e.g. molochite), aluminium oxide and zircon silicate. In a particular embodiment, the first (relatively coarse) fraction comprises particles having flake-like or sheet-like morphology. Particles having flake-like or sheet-like morphology include crystalline graphite, muscovite (mica), pyrophillite, talc and micaceous iron oxide. In a further embodiment, the first (relatively coarse) fraction comprises crystalline (flake) graphite. In a further embodiment, the first (relatively coarse) fraction consists of crystalline (flake) graphite.

In one embodiment, the second (relatively fine) fraction comprises particles having spherical morphology. Red iron oxide (haematite) is an example of a particle having spherical morphology. In another embodiment, the second (relatively fine) fraction comprises particles having rod-like morphology. Palygorskite (attapulgite), sepiolite, yellow iron oxide (hydrated iron oxide e.g goethite or lepidocrocite), and wollastonite are examples of particles having rod-like morphology. In a further embodiment, the second (relatively fine) fraction comprises both particles having spherical morphology and particles having rod-like morphology. In a particular embodiment the second (relatively fine) fraction comprises iron oxide.

In one embodiment, the second (relatively fine) fraction comprises particles having lamellar or platelet morphology. Calcined kaolin and mica are examples of particles having lamellar morphology.

In one embodiment, the second (relatively fine) fraction comprises calcined kaolin. In one series of embodiments, no more than 50%, 45%, 40% or 35% of the second (relatively fine) fraction is constituted by calcined kaolin. The presence of calcined kaolin is shown to be beneficial within certain limits. High proportions of calcined kaolin are shown to have adverse effects on the coating composition.

In a further embodiment, the second (relatively fine) fraction comprises from 0 to 50% silicate-based minerals that do not form gel structures.

In a yet further embodiment, the second (relatively fine) fraction comprises from 0 to 50% particles that do not form gel structures.

In one series of embodiments, the second (relatively fine) fraction comprises non-gel forming particles with lamellar or platelet morphology (including silicate based minerals), the particles constituting no more than 50%, 45%, 40% or 35% of the second (relatively fine) fraction.

The percentages may be calculated by weight (wt %) or by volume (vol %). Mica and calcined kaolin are examples of silicate based minerals which have lamellar morphology and which do not form gel structures.

The first (relatively coarse) fraction and the second (relatively fine) fraction may be constituted by the same or different particulate refractory fillers.

The liquid carrier serves to transport the particulate refractory filler onto and into the sand substrate. It should be removed before casting takes place. In one embodiment, the liquid carrier is water. In other embodiments, the liquid carrier is a volatile organic liquid carrier such as isopropanol, methanol or ethanol.

The function of the binder is to bond the filler particles together and to provide adhesion to the mould or core. In one embodiment, the binder comprises one or more of the polymers polyvinylalcohol, polyvinylacetate, dextrine or polyacrylate.

The rheology of the system is determined by the number of particles and the volume they occupy (relative to the liquid carrier). The size and shape of the particles strongly influences the rheology; fine particles have a bigger influence because of the relatively high surface area that interacts with the liquid carrier, whereas aggregation of particles decreases their influence. Certain rod-shaped particles such as attapulgite are known to form a gel-like structure and this can be controlled by the addition of one or more dispersants. In one embodiment, the foundry coating composition additionally comprises a dispersant. Suitable dispersants include polyacrylates (sodium and ammonium), ligno-sulphonates and polyphosphates.

Biocides may be added to the coating, if the liquid carrier is water.

According to a second aspect of the present invention there is provided a process for the preparation of a coated foundry mould or core comprising providing a foundry mould or core;

applying the foundry coating composition of the first aspect to the foundry mould or core; and removing the liquid carrier.

The process is advantageous in that the coated foundry mould or core, having both an absorbed layer and a surface layer, is obtained in a single step.

In one embodiment, the composition is applied by dipping, brushing, swabbing, spraying or overpouring.

In one series of embodiments, the foundry coating composition is applied to the foundry mould or core to obtain an absorption depth of from 1 to 10 mm, from 1.5 mm to 8 mm, from 2 to 6 mm, from 2.5 mm to 5 mm or from 3 to 4 mm. It will be understood that, within certain limits, increased absorption depth can be obtained by adjusting the application parameters of the foundry coating composition e.g. dipping time, viscosity etc. Where the coating is applied by dipping, increased absorption depth may be obtained by increasing the dipping time. The foundry coating composition of the present invention has been found to provide greater absorption depths than prior art coatings and the inventors propose that the increased absorption depth results from the removal of the critical fraction.

In another series of embodiments, the foundry coating composition is applied to the foundry mould or core to obtain a surface layer thickness of from 100 to 1000 μm, from 100 to 800 μm, from 150 to 600 μm, from 200 to 450 μm or from 250 to 350 μm.

In one embodiment, the liquid carrier is removed by drying. Drying may be achieved by placing coated cores and moulds in conventional gas or electric heated drying ovens, or by the use of microwave ovens. Drying may be employed when the liquid carrier is water or a volatile organic liquid. In an alternative embodiment, the carrier liquid is removed by burning. This method may be employed when the liquid carrier is isopropanol.

The foundry mould or core may comprise silica sand, zircon sand, chromite sand, olivine sand or a combination thereof. In one embodiment, the foundry mould or core comprises silica sand. The size, distribution and grain shape all have an influence on the quality of castings. Coarse grained sands tend to result in greater metal penetration giving poor surface finish to castings, whereas fine grained sands give better surface finish but need higher binder levels which may cause gas defects. Silica sand for cores typically has a $SiO_2$ content of 95-65% minimum, an AFS Fineness Number of 40-60, an average grain size of 220-340 microns, and preferably rounded or sub-rounded grains. Sand for moulds is often slightly coarser, having an AFS Fineness value of 35-50 and an average grain size of 280-390 microns.

It will be appreciated that the size and the grain shape of the sand will have some influence on the permeability and hence the depth of absorption of a particular coating of the invention. As a general rule, moulds and cores produced using sand which has coarse and/or angular or sub-angular grains will be more permeable and hence absorb the coating to a greater depth than fine and/or rounded sand cores and moulds.

The invention also resides in coated foundry moulds or cores obtainable by the process of the second aspect.

The coated moulds and cores obtainable by the process of the second aspect comprise a first (surface coating) and a second (absorbed) coating, each of the first and second coatings comprising the particulate refractory filler. The first (relatively coarse) fraction forms the first (surface) coating and the second (relatively fine) fraction forms the second (absorbed) coating.

In one series of embodiments, the thickness of the first (surface) layer is from 100 to 800 μm, from 150 to 600 μm, from 200 to 450 μm or from 250 to 350 μm.

In another series of embodiments, the depth of the second (absorbed) refractory layer is from 1 to 10 mm, from 1.5 mm to 8 mm, from 2 to 6 mm, from 2.5 mm to 5 mm or from 3 to 4 mm.

BRIEF DESCRIPTION OF THE DRAWINGS

Embodiments of the invention will now be described by way of example only with reference to the following figures.

METHODOLOGY

Figure 1:
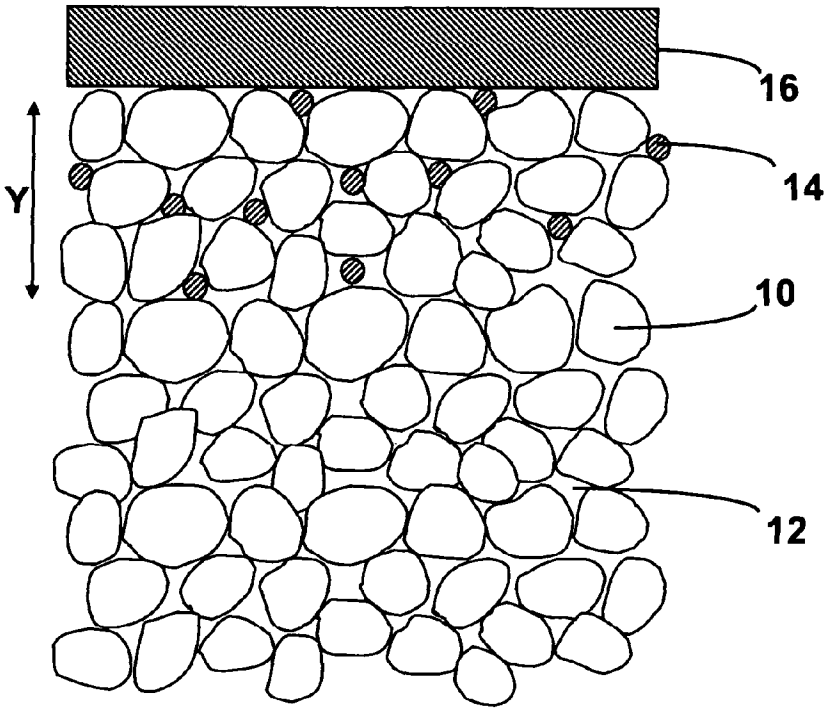
FIG. 1 is a schematic drawing of part of a mould or core in accordance with an embodiment of the invention.

Aqueous coatings were prepared having polyvinyl alcohol as a binder and sodium polyacrylate to control the rheology of the composition. The general composition of each coating composition was:

40 to 60 wt % liquid carrier (water);

0.2 to 2.0 wt % binder 0 to 4 wt % dispersant, 0 to 0.5 wt % biocide 10 to 30 wt % coarse particulate refractory filler (first fraction, d>38 μm)

20 to 30 wt % fine particulate refractory filler (second fraction, d<38 μm)

The fine particulate refractory fillers (including the clay gelling agent (attapulgite), red iron oxide, yellow iron oxide and calcined clay) all had a particle size distribution such that all material was <25 μm, and most material was <10 μm.

Coarse particulate refractory fillers comprised graphite and molochite (an aluminosilicate). Commercially available grades of flake graphite and molochite were tested as received, and also after processing to remove specific material fractions. The classified graphite or molochite, and or the specific sieve fractions removed were used to produce the test coatings. Theoretically, classification should remove all of the fine material (<38 μm), however, analysis showed that there was a very low level of residual fines and critical fraction, attributed to material loosely adhering to coarser particles), as detailed in the table 1 below. Refractory filler having trace critical fraction (shown as 0% in table 2b) was obtained by classifying to remove material having higher particle sizes e.g graphite C (d>75 μm) and graphite D (d>106 μm).

TABLE 1

| | Graphite A (As Received) | Graphite B (d < 53 Removed) |
|---|---|---|
| Critical Fraction (38 < d < 53) | 22% | 3.0% |
| Fine fraction (d < 38) | 2.9% | 0.7% |

Each coating was prepared and diluted to a DIN #4 Cup viscosity of 12.5 seconds (+/−0.5 seconds).

The coatings were compared to commercially available coatings including RHEOTEC XL® a water based anti-veining refractory dip coating supplied by Foseco (Comp Ex 1), and a general isopropanol based coke core-wash BBE™ supplied by Foseco (Comp Ex 2).

The formulations and properties of the coatings are given in table 2.

TABLE 2a

Coatings Formulations

| | Ex 1 | Ex 2 | Ex 3 | Ex 4 | Ex 5 | Ex 6 | Ex 7 | Ex 8 | Ex 9 | Ex 10 | Ex 11 |
|---|---|---|---|---|---|---|---|---|---|---|---|
| Attapulgite | 4.5 | 4.4 | 3.7 | 4.4 | 4.5 | 4.6 | 4.5 | 9.4 | 4.9 | 4.8 | 4.8 |
| Red Iron Oxide (Fine) | 16.0 | 15.6 | 7.9 | 15.7 | 16.2 | 16.5 | 16.0 | 16.9 | 0.0 | 2.0 | 6.0 |
| Yellow Iron Oxide (Fine) | 7.2 | 7.0 | 5.0 | 7.1 | 7.3 | 7.4 | 7.2 | 0.0 | 7.8 | 7.7 | 7.7 |
| Calcined Clay (Fine) | 0.0 | 0.0 | 7.3 | 0.0 | 0.0 | 0.0 | 0.0 | 0.0 | 8.7 | 7.6 | 5.6 |
| Binders, Rheology Modifiers, Biocides etc | 5.7 | 5.5 | 3.0 | 5.8 | 6.3 | 5.8 | 5.7 | 5.3 | 6.2 | 6.1 | 3.0 |
| Graphite A | 0.0 | 5.7 | 0.0 | 0.0 | 0.0 | 0.0 | 5.9 | 0.0 | 0.0 | 0.0 | 0.0 |
| Graphite B | 18.0 | 14.6 | 15.4 | 19.4 | 16.4 | 15.6 | 12.1 | 0.0 | 19.6 | 19.3 | 17.4 |
| Graphite C (d > 75) | 0.0 | 0.0 | 0.0 | 0.0 | 0.0 | 0.0 | 0.0 | 11.9 | 0.0 | 0.0 | 0.0 |
| Graphite D (d > 106) | 0.0 | 0.0 | 0.0 | 0.0 | 0.0 | 0.0 | 0.0 | 0.0 | 0.0 | 0.0 | 0.0 |
| Graphite E (38 < d < 53) | 0.0 | 0.0 | 0.0 | 0.0 | 0.0 | 0.0 | 0.0 | 0.0 | 0.0 | 0.0 | 0.0 |
| Molochite B (d > 106) | 0.0 | 0.0 | 0.0 | 0.0 | 0.0 | 0.0 | 0.0 | 0.0 | 0.0 | 0.0 | 0.0 |
| Molochite A 38 < d < 53 | 0.0 | 0.0 | 0.0 | 0.0 | 0.0 | 0.0 | 0.0 | 0.0 | 0.0 | 0.0 | 0.0 |
| Water | 48.6 | 47.2 | 57.7 | 47.6 | 49.2 | 50.1 | 48.6 | 56.5 | 52.8 | 52.4 | 55.5 |
| TOTAL | 100.0 | 100.0 | 100.0 | 100.0 | 100.0 | 100.0 | 100.0 | 100.0 | 100.0 | 100.0 | 100.0 |

| | Ex 12 | Ex 13 | Comp Ex 1 | Comp Ex 3 | Comp Ex 4 | Comp Ex 5 | Comp Ex 6 | Comp Ex 7 |
|---|---|---|---|---|---|---|---|---|
| Attapulgite | 10.2 | 9.8 | n/a | 4.1 | 5.0 | 5.1 | 10.2 | 9.8 |
| Red Iron Oxide (Fine) | 18.3 | 17.5 | n/a | 14.6 | 0.0 | 2.1 | 18.3 | 17.5 |
| Yellow Iron Oxide (Fine) | 0.0 | 0.0 | n/a | 6.5 | 0.0 | 0.0 | 0.0 | 0.0 |
| Calcined Clay (Fine) | 0.0 | 0.0 | n/a | 0.0 | 19.0 | 13.1 | 0.0 | 0.0 |
| Binders, Rheology Modifiers, Biocides etc | 5.9 | 5.6 | n/a | 5.2 | 3.1 | 6.1 | 5.9 | 5.6 |
| Graphite A | 0.0 | 0.0 | n/a | 25.6 | 0.0 | 0.0 | 0.0 | 0.0 |
| Graphite B | 0.0 | 0.0 | n/a | 0.0 | 20.3 | 17.7 | 0.0 | 0.0 |
| Graphite C (d > 75) | 0.0 | 0.0 | n/a | 0.0 | 0.0 | 0.0 | 0.0 | 0.0 |
| Graphite D (d > 106) | 16.5 | 0.0 | n/a | 0.0 | 0.0 | 0.0 | 8.2 | 0.0 |
| Graphite E (38 < d < 53) | 0.0 | 0.0 | n/a | 0.0 | 0.0 | 0.0 | 8.2 | 0.0 |
| Molochite B (d > 106) | 0.0 | 20.2 | n/a | 0.0 | 0.0 | 0.0 | 0.0 | 10.1 |
| Molochite A 38 < d < 53 | 0.0 | 0.0 | n/a | 0.0 | 0.0 | 0.0 | 0.0 | 10.1 |
| Water | 49.1 | 46.9 | n/a | 44.1 | 52.6 | 55.8 | 49.1 | 46.9 |
| TOTAL | 100.0 | 100.0 | n/a | 100.0 | 100.0 | 100.0 | 100.0 | 100.0 |

TABLE 2b

| Coatings Properties and Filler Ratios | | | | | | | | | | |
|---|---|---|---|---|---|---|---|---|---|---|
| | Ex 1 | Ex 2 | Ex 3 | Ex 4 | Ex 5 | Ex 6 | Ex 7 | Ex 8 | Ex 9 | Ex 10 |
| Weight Ratios | | | | | | | | | | |
| Fines ($2^{nd}$) Fraction (wt % of total fillers) | 60.9 | 57.6 | 61.1 | 58.6 | 63.3 | 64.9 | 61.2 | 68.8 | 52.6 | 53.7 |
| Coarse ($1^{st}$) Fraction (wt % of total fillers) | 39.1 | 42.4 | 38.9 | 41.4 | 36.7 | 35.1 | 38.8 | 31.2 | 47.4 | 46.3 |
| Coarse:Fines (Weight Ratio) | 0.6 | 0.7 | 0.6 | 0.7 | 0.6 | 0.5 | 0.6 | 0.5 | 0.9 | 0.9 |
| Critical Fraction (wt % of total fillers) | 1.1 | 3.5 | 1.1 | 1.2 | 1.1 | 1.0 | 3.6 | 0 | 1.4 | 1.4 |
| Critical Fraction (wt % of coarse fillers) | 2.9 | 8.2 | 2.9 | 2.9 | 2.9 | 2.9 | 9.1 | 0 | 2.9 | 2.9 |
| Volume Ratios | | | | | | | | | | |
| Fines ($2^{nd}$) Fraction (vol % of total fillers) | 43.5 | 40.3 | 49.0 | 41.2 | 46.1 | 47.8 | 43.9 | 54.8 | 43.5 | 43.5 |
| Coarse ($1^{st}$) Fraction (vol % of total filters) | 56.5 | 59.7 | 51.0 | 58.8 | 53.9 | 52.2 | 56.1 | 45.2 | 56.5 | 56.5 |
| Coarse:Fines (Volume Ratio) | 1.3 | 1.5 | 1.0 | 1.4 | 1.2 | 1.1 | 1.3 | 0.8 | 1.3 | 1.3 |
| Critical Fraction (vol % of total fillers) | 1.7 | 5.0 | 1.5 | 1.7 | 1.6 | 1.5 | 5.2 | 0 | 1.6 | 1.6 |
| Critical Fraction (vol % of coarse fillers) | 2.9 | 8.2 | 2.9 | 2.9 | 2.9 | 2.9 | 9.1 | 0 | 2.9 | 2.9 |

| | Ex 11 | Ex 12 | Ex 13 | Comp Ex 1 | Comp Ex 3 | Comp Ex 4 | Comp Ex 5 | Comp Ex 6 | Comp Ex 7 |
|---|---|---|---|---|---|---|---|---|---|
| Weight Ratios | | | | | | | | | |
| Fines ($2^{nd}$) Fraction (wt % of total fillers) | 58.4 | 63.4 | 57.4 | 70.2 | 51.1 | 54.6 | 53.8 | 63.4 | 57.4 |
| Coarse ($1^{st}$) Fraction (wt % of total fillers) | 41.6 | 36.6 | 42.6 | 29.8 | 48.9 | 45.4 | 46.2 | 36.6 | 42.6 |
| Coarse:Fines (Weight Ratio) | 0.7 | 0.6 | 0.7 | 0.4 | 1.0 | 0.8 | 0.9 | 0.6 | 0.7 |
| Critical Fraction (wt % of total fillers) | 1.2 | 0 | 0 | 5.1 | 10.9 | 1.3 | 1.3 | 18.3 | 21.3 |
| Critical Fraction (wt % of coarse fillers) | 2.9 | 0 | 0 | 17.0 | 21.7 | 2.9 | 2.9 | 50.0 | 50.0 |
| Volume Ratios | | | | | | | | | |
| Fines ($2^{nd}$) Fraction (vol % of total fillers) | 46.0 | 48.7 | 48.8 | 70 | 34.6 | 49.3 | 47.2 | 48.7 | 48.8 |
| Coarse ($1^{st}$) Fraction (vol % of total filters) | 54.0 | 51.3 | 51.2 | 30 | 65.4 | 50.7 | 52.8 | 51.3 | 51.2 |
| Coarse:Fines (Volume Ratio) | 1.2 | 1.1 | 1.1 | 0.4 | 1.9 | 1.0 | 1.1 | 1.1 | 1.1 |
| Critical Fraction (vol % of total fillers) | 1.6 | 0 | 0 | 5.0 | 14.6 | 1.5 | 1.5 | 25.6 | 25.6 |
| Critical Fraction (vol % of coarse fillers) | 2.9 | 0 | 0 | 16.5 | 21.7 | 2.9 | 2.9 | 50.0 | 50.0 |

The coatings were investigated by dipping cylindrical silica sand cores having a diameter of 50 mm and 90 mm height. Unless stated otherwise, the sand used was Haltern H32, having an AFS Fineness No 45 and an average grain size of 322 μm. The cores were bonded using an amine cured phenolic urethane cold box binder (0.6 wt % Part I+0.6% wt Part II). The typical dip length of the cores was 60-65 mm and the dipping time 2-15 seconds.

Absorption Depth and Thickness of Surface Layer

A series of coatings Comp Ex 3, Ex 2 and Ex 1 were prepared with a critical fraction of 21.7 wt %, 8.2 wt % and 2.9 wt % relative to the first (relatively coarse) fraction and 10.9 wt %, 3.5 wt % and 1.1 wt % relative to the total particulate refractory fillers, as detailed in tables 2a and 2b.

Figure 2:
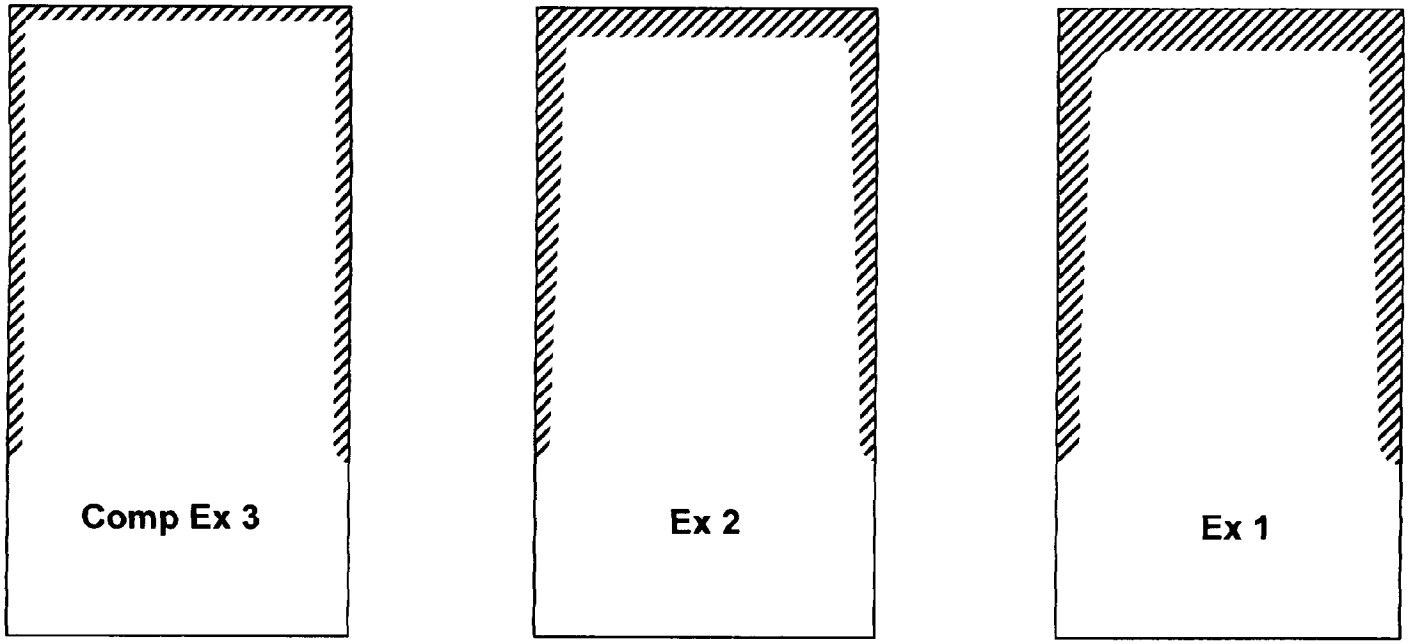
FIG. 2 is a schematic drawing of two cores in accordance with the invention and one comparative example.

Three cores were dipped into the coatings for a dipping time of 9 seconds. The results are shown schematically in FIG. 2. The depth of penetration increases as the proportion of the critical fraction decreases. This effect is attributed to the critical fraction blocking the pores in the core and hindering absorption.

Absorption Depth

Three coatings Ex 1, Ex 2 and Comp Ex 3, were compared to a conventional anti-veining coating having a critical fraction of 17.0 wt % of the first (relatively coarse) fraction, equivalent to 5.1 wt % of the total refractory filler (Comp Ex 1). The depth of absorption of the coating into the core, the weight of the coating absorbed into the core and the thickness of the surface coating on the core were all measured for a range of dipping times between 0 and 15 seconds.

Figure 3:
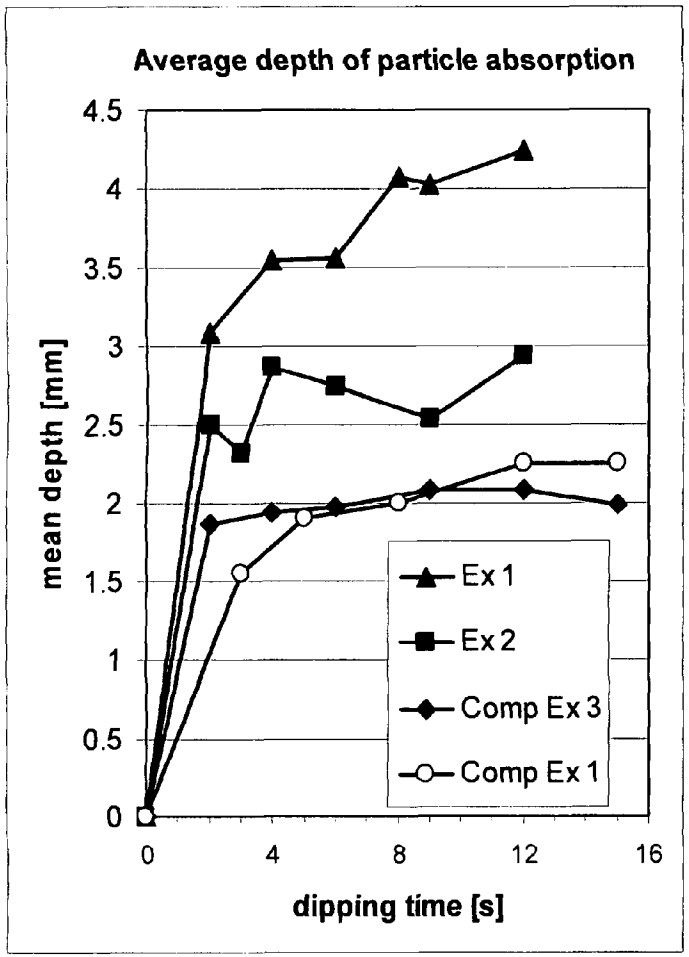

The results of the depth of absorption investigation are plotted on the graph shown in FIG. 3. It can be seen that the depth of absorption increases with dipping time in all cases and the greatest absorption (~4.3 mm at 12 s) is achieved with Ex 1 which has 2.9 wt % critical fraction (based on weight of coarse fraction). The graph levels off at around 2 mm for both Comp Ex 1 (17.0 wt % of the coarse fraction) and Comp Ex 3 (21.7 wt % of the coarse fraction) indicating that very little extra depth will be achieved even if dipping time is increased. This suggests that the pores may be being blocked by the critical fraction thereby hindering further absorption.

Figure 4:
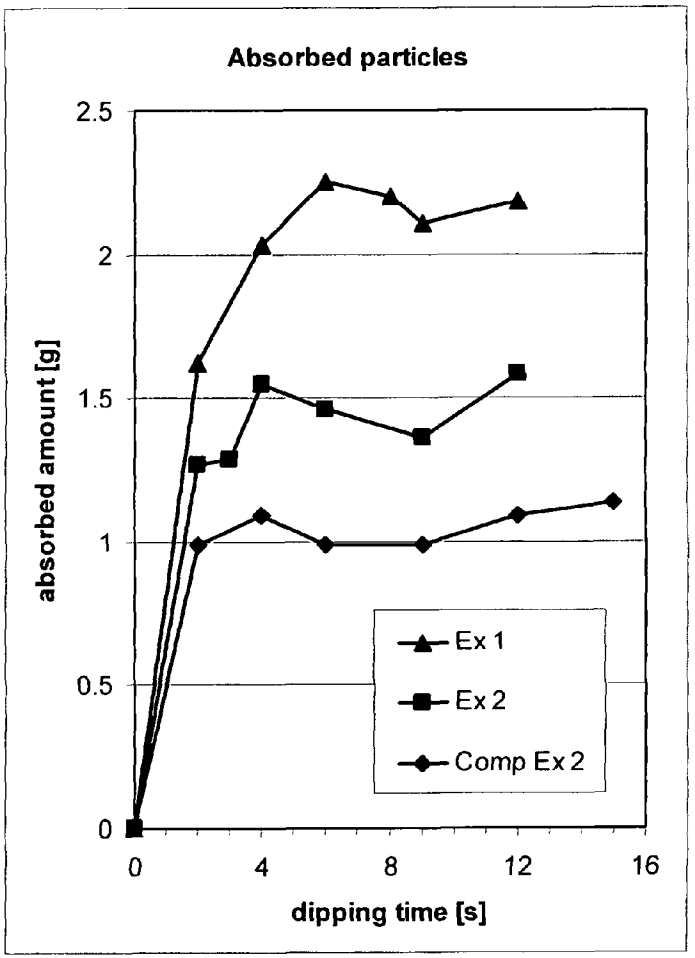
FIGS. 3 to 6 are graphs showing properties of a selection of cores in accordance with embodiments of the invention together with comparative examples.

The results of the weight of absorbed particles investigation are plotted on the graph shown in FIG. 4. Similar to the results obtained from the depth of absorption investigation, it can be seen that the amount of absorbed particles increases with dipping time in all cases and the greatest absorption (~2.2 g) is achieved with Ex 1 having a 2.9 wt % critical fraction based on weight of coarse fraction and 1.1 wt % critical fraction based on the weight of the total refractory fillers.

Figure 5:
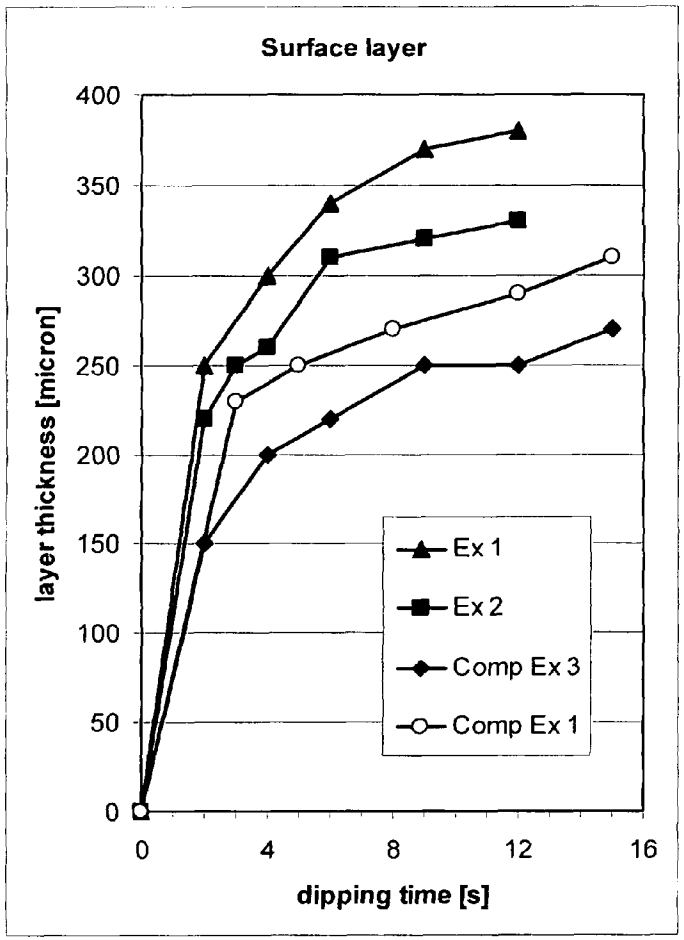

The results of the surface layer thickness investigation are plotted in the graph shown in FIG. 5. The thickness of the layer increases as the proportion of the critical fraction decreases. A thickness of around 380 μm is achieved with a coating having 2.9 wt % critical fraction (based on weight of coarse fraction) and 1.1 wt % critical fraction based on the weight of the total refractory fillers.

Effect of Sand Type on Depth of Absorption

A series of cores were prepared using different groups of foundry sand from Germany—Haltern (H) sand and Frechener (F) sand. For each group of sands, a range of grades were selected, having different grain sizes as detailed in table 3 below.

TABLE 3

| | H31 | H32 | H33 | F31 | F32 | F33 |
|---|---|---|---|---|---|---|
| AFS Fineness Number | 42 | 45 | 52 | 46 | 58 | 62 |
| Average Grain Size (mm) | 0.367 | 0.322 | 0.276 | 0.322 | 0.243 | 0.231 |
| Binder Addition Level (Total Pt 1 + Pt 2) | 1.2% | 1.2% | 1.2% | 1.6% | 1.6% | 1.6% |
| Absorption Depth (mm) | 2.8 | 3.5 | 2.4 | 2.8 | 2.7 | 2.7 |

The sands were used to produce a series of sand cores, noting that due to the increased binder demand associated with the particles size and distribution of the Frechener silica, the binder addition level used was 0.8 wt % Part 1+0.8 wt % Part 2, the addition level for the Haltern sand remaining at 0.6 wt %+0.6 wt %.

All of the cores were dipped (for 3 seconds) in a coating Ex 3 prepared with a critical fraction of 2.9 wt % (based on weight of the coarse fraction) as detailed in tables 2a and 2b.

Figure 6:
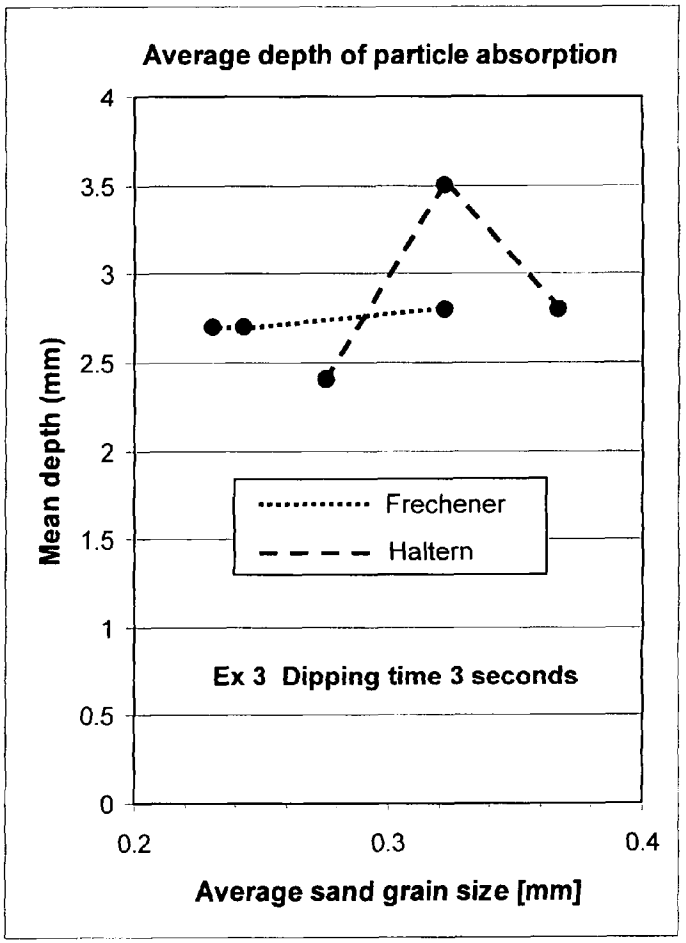

The results can be seen in FIG. 6. It seems that the particle size of the sand has relatively little effect on the depth of absorption in the sands that were tested.

Therefore we believe that the compositions of the invention will be suitable for use in range of foundry sands.

Veining Casting Block Tests

Figure 7A:
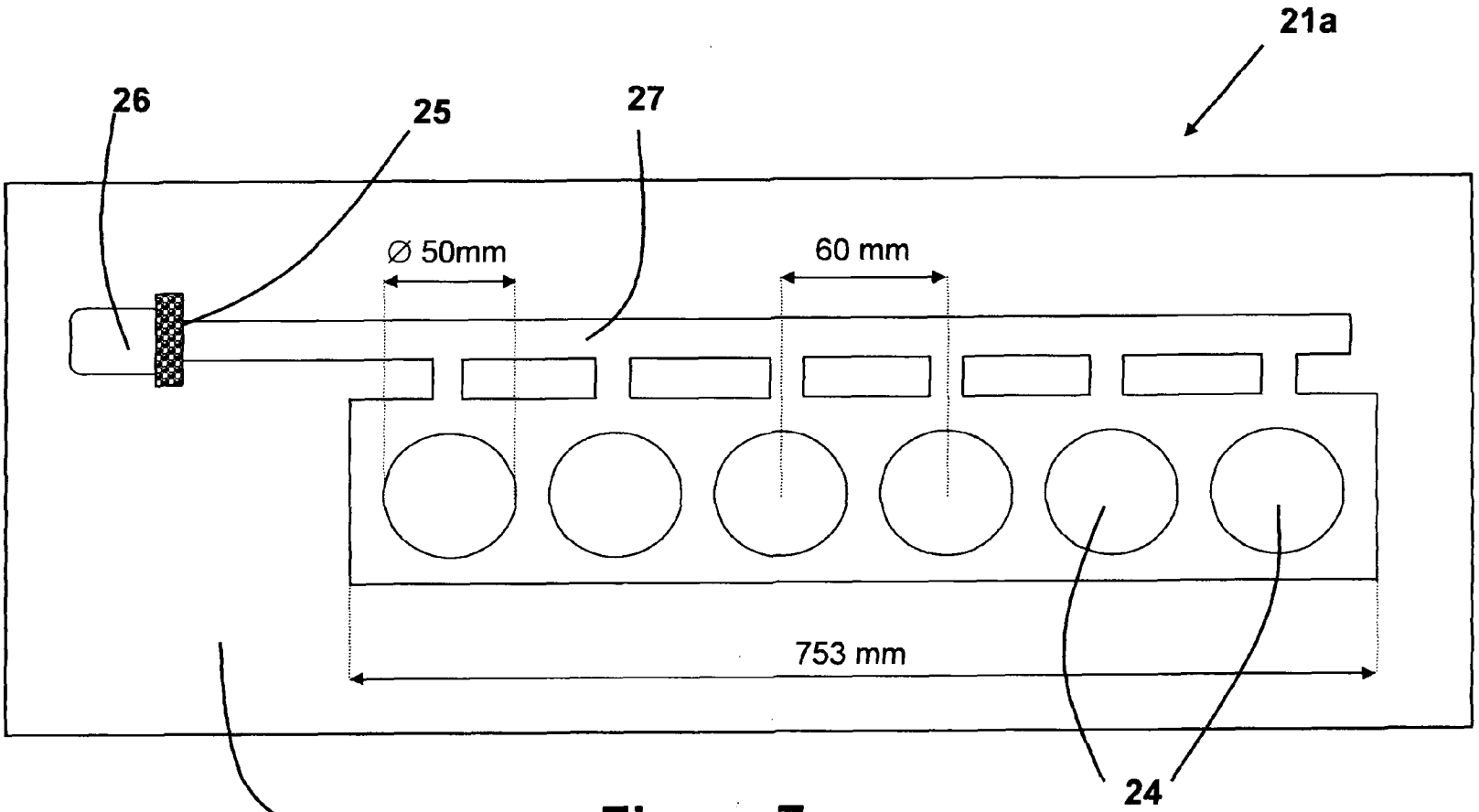
FIGS. 7*a*, 7*b* and 8 are diagrams of casting design and moulds used to carry out veining block tests.
Figure 7B:
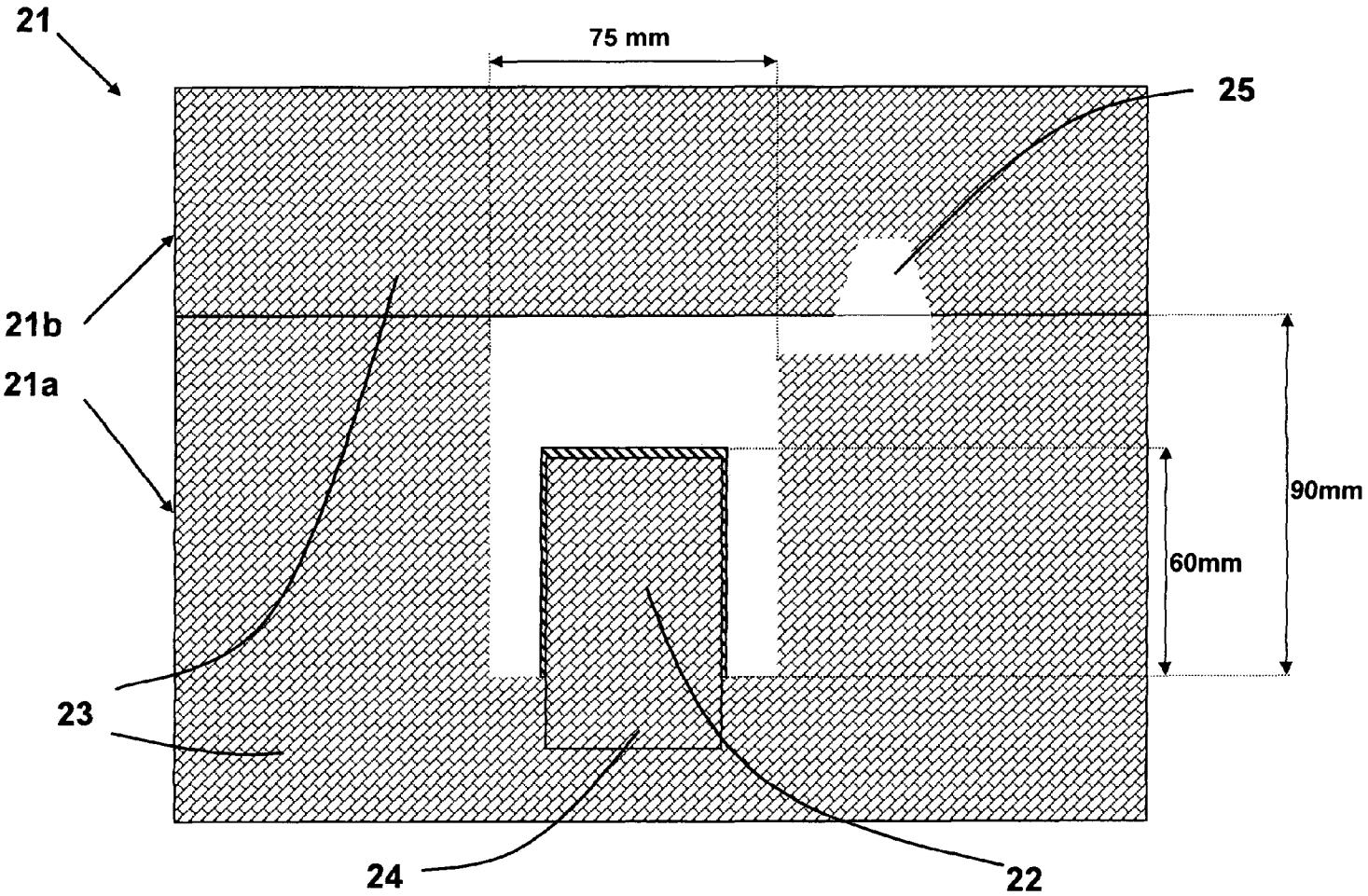

A plan view of the bottom half (drag) mould 21*a* of a veining block casting mould assembly is shown in FIG. 7*a*, and has locations for placing six different coated cores for testing. FIG. 7*b* is a side view of a complete mould assembly 23 comprising a bottom (drag) half 21*a*, a top (cope) half 21*b* and a coated test core 22.

The sand mould 21 is produced from Haltern H32 silica sand bonded by a furfuryl alcohol based self set resin binder (ESHANOL® U3N furan resin) hardened with an acid catalyst (p-toluene sulphonic acid). The binder addition levels used were 1% resin by weight based on the weight of sand and 40% catalyst based on the weight of resin.

The sand cores were produced using Haltern H32 silica sand bonded with a polyurethane cold box binder system (0.6 wt % Part I+0.6 wt % Part 2). Cylindrical cores of 50 mm diameter and 90 mm length were dipped in the test coating to an immersion depth of 62 mm, and the coated cores dried in an oven at 120° C. for 1 hour and allowed to cool. Once dried, the coated cores 22 were placed in a recess 24 in the bottom (drag) half 21*a* of the mould. The cores 22 were placed with the core print (uncoated end) in the base of the mould, such that only the coated part of the core was protruding into the casting cavity. A 10 ppi (pores per square inch), 50 mm×50 mm silicon carbide filter 25 was placed in the between the downsprue 26 and runner 27.

The metal casting was grey (flake graphite) cast iron with a carbon content in the range 3.3 to 3.5% and a silicon content of 2.2 to 2.3%. The pouring temperature of the metal was 1425° C.±5° C. and the mould filling time was 8 to 10 seconds. The casting weight was 13.1 kg.

Figure 9:
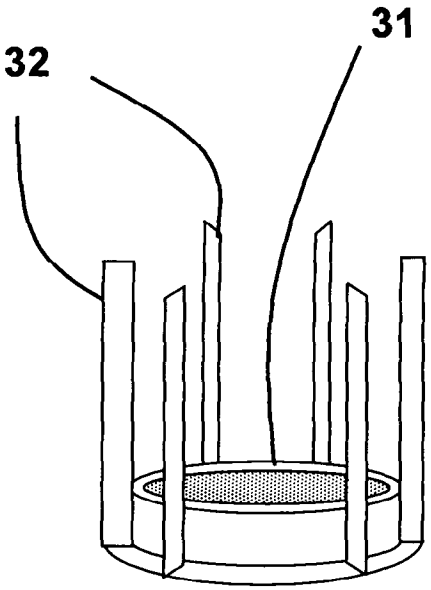
FIG. 9 is a diagram demonstrating casting defects in a core.
Figure 8:
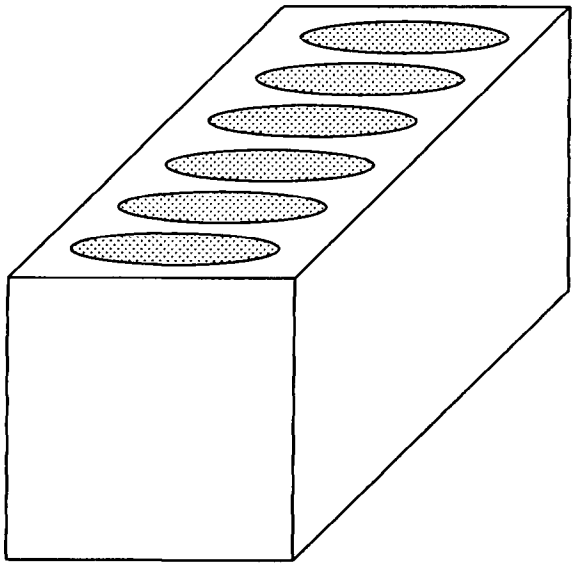
Figure 10:
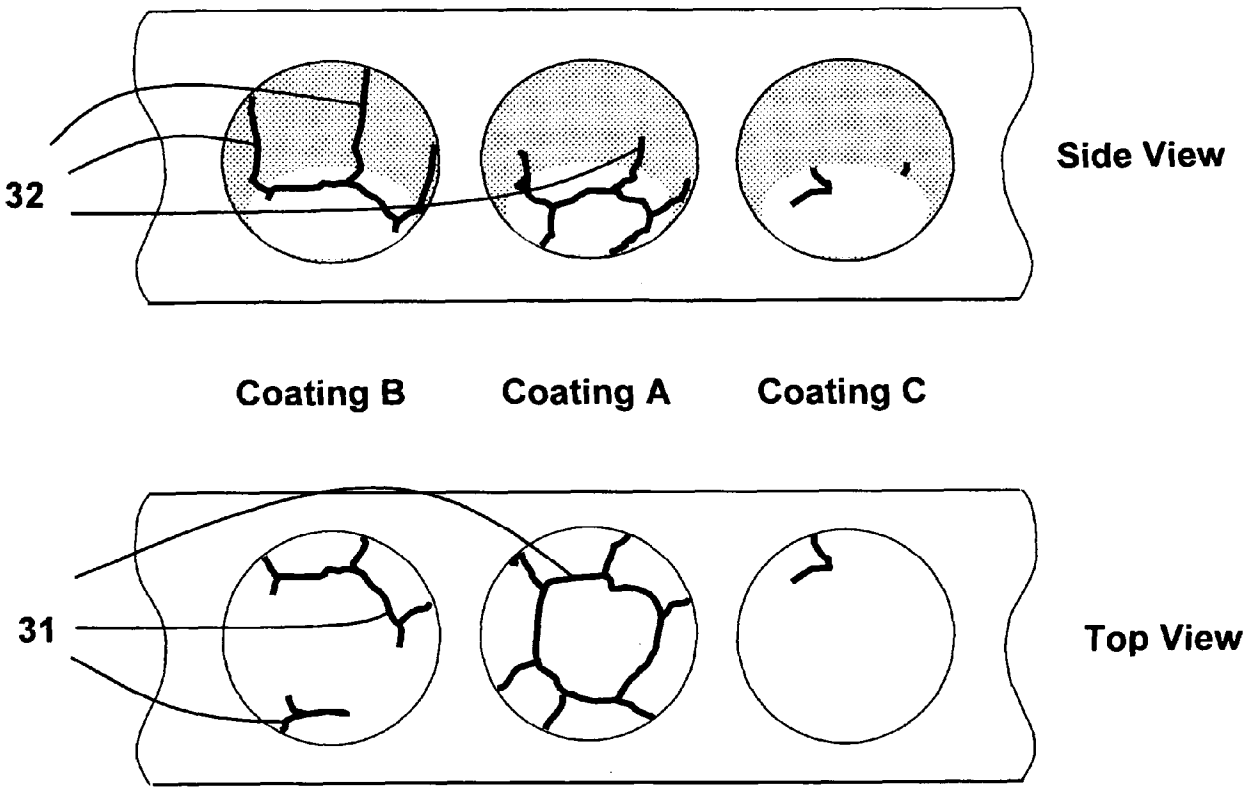
FIG. 10 is a schematic drawing of the results of a veining block test.

After solidification and cooling, the casting was removed from the mould and the cores shaken out of the casting. The internal cavities of the casting block were then inspected to assess the level of veining and other general casting properties, FIG. 8 shows a view of a casting block, and FIG. 9 is an artist's impression of a full veining pattern seen on the interior of the casting cavities. This consists of a circular vein 31 at the bottom of the casting (base of the core) and wall veins 32 protruding from the casting cavity walls. FIG. 10 shows a schematic of a casting block produced with three different types of coatings to illustrate the types of veining defects that are observed. The middle coating A gives a test casting with a bottom vein that is 100% full circle, plus short wall veins. The left hand coating B has a bottom vein of 55% and long extensive side veins, whereas Coating C has little veining.

It should be noted that there are some small casting to casting variations in the veining block tests i.e. they are for comparing performance against known standards to obtain qualitative rather than quantitative performance.

Veining Block Tests 1

Three coatings Ex 4, Ex 1 and Ex 5, each with the same critical fraction of 2.9 wt % based on weight of the coarse (first) fraction, but with a different coarse (first fraction) wt %: fines (second fraction) wt % ratios and consequently differing critical fraction of 1.21 wt %, 1.14 wt % and 1.07 wt % respectively based on the total refractory filler, were prepared as detailed in tables 2a and 2b.

A veining block casting was produced using cores coated individually with Ex 1, Ex 4 and Ex 5 coating, and compared to comparative coatings Comp Ex 1 and Comp Ex 2. The casting results are shown below in table 4.

TABLE 4

| | Ex 4 | Ex 1 | Ex 5 | Comp Ex 1 | Comp Ex 1[1] | Comp Ex 2 |
|---|---|---|---|---|---|---|
| Bottom Vein (%) | trace | 0 | 0 | 100 | 80 | 100 |
| Number of wall veins | 2 | 0 | 0 | 6 | 1 | 6 |
| Total length of wall veins (cm) | 1.5 | 0.0 | 0.0 | 3.5 | 0.5 | 30.0 |

[1]Core sand contained 4% by weight NORACEL anti-veining sand additive

The results show that all of the coatings Ex 1, Ex 4 and Ex 5 give a significantly lower level of veining defects (both bottom and side wall veins) compared to a conventional anti-veining coating Comp Ex 1 (100% bottom veining) and a basic refractory wash coating Comp Ex 2 which has extensive bottom and side wall veins.

Veining Block Tests 2—Influence of Coating Penetration Depth

Four coatings Ex 1, Ex 6 and Ex 7 with critical fraction of 2.9 wt %, 2.9 wt % and 9.1 wt % based on the first (coarse) fraction (1.1 wt %, 1.0 wt % and 3.6 wt % of the total refractory fillers), were prepared as detailed in tables 2a and 2b, the formulations adjusted to give a similar layer thickness at the same dipping time (9 seconds).

The average absorption depth and top layer coating thickness were measured, and the results are shown in table 5, together with the veining block casting trial results.

TABLE 5

| | Ex 1 | Ex 6 | Ex 7 |
|---|---|---|---|
| Coated Core Properties | | | |
| Surface Layer (μm) | 290 | 300 | 290 |
| Average Absorption Depth (mm) | 3.9 | 3.5 | 2.4 |
| Veining Block Results | | | |
| Bottom Vein (%) | 0 | 0 | 70 |
| Total length of wall veins (cm) | 0 | 0 | 7 |

The results indicate that the optimum depth of penetration is >3 mm, however effective anti-veining comparable to current state of the art coatings is achievable with depths of absorption of the order 2.5 mm.

Veining Block Tests 3

A series of coatings was prepared to assess the effect of fines composition (second fraction) on a range of coatings having similar levels of the critical fraction, as detailed in tables 2a and 2b below.

The average absorption depth and top layer coating thickness were measured, and the results are shown in table 6, together with the veining block casting trial results.

TABLE 6

| | Ex 1 | Ex 3 | Ex 8 | Ex 9 | Ex 10 | Ex 11 | Comp Ex 4 | Comp Ex 5 |
|---|---|---|---|---|---|---|---|---|
| Coated Core Properties | | | | | | | | |
| Top Layer (μm) | 280 | 340 | 300 | 290 | 290 | 320 | 300 | 310 |
| Average Absorption Depth (mm) | 3.3 | 2.9 | 3.1 | 4.0 | 3.2 | 3.3 | 4.1 | 3.5 |
| Veining Block Results | | | | | | | | |
| Bottom Vein (%) | 0 | 0 | 0 | 0 | 0 | 0 | 100 | 60 |
| Total length of wall veins (cm) | 0 | 1.5 | 0 | 2.5 | 2 | 0 | 7 | 9 |

The results show that the good anti-veining properties can be achieved with a range of iron oxide (red, yellow or a combination) and aluminosilicate fillers (attapulgite and calcined kaolin)—see Ex 1, Ex 3 and Ex 8-11. However, high levels (>50 vol % of the fine fraction) of calcined kaolin (calcined clay) results in a reduction in performance (Comp Ex 4 and Comp Ex 5), though still comparable with state of the art coatings. The results indicate that both the physical properties (rod or spheres or lamellar shaped particles) and the chemical composition (iron oxide and aluminosilicates) may have an influence on the absorption and anti-veining properties of the coating Influence of the Morphology of the Coarse Particles A series of coatings (Ex 12, Ex 13, Comp Ex 6 and Comp Ex 7) were prepared to investigate the effect of the coarse particle shape on the absorption properties of the coating. Ex 12 and Comp Ex 6 contain graphite whereas Ex 13 and Comp Ex 7 contain molochite as detailed in tables 2a and 2b. Graphite has a flat flake-like particle shape, whereas molochite has a more three-dimensional, angular grain shape. Particular sieve fractions of graphite and molochite were chosen such that Ex 12 and 13 had trace critical fraction and Comp Ex 6 and 7 had 50% critical fraction relative to the first (coarse) fraction.

Figure 11:
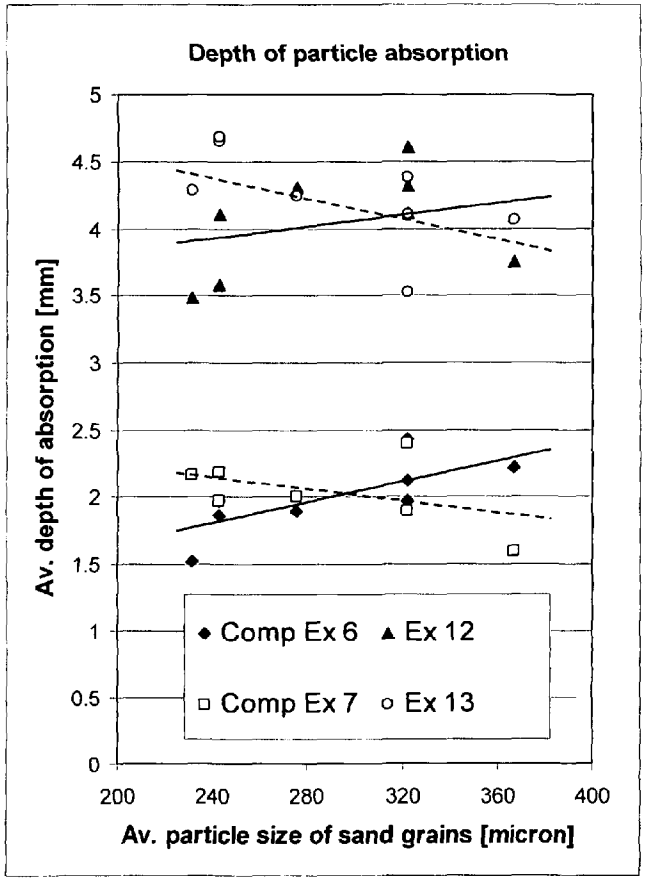

The coatings were then used to coat a series of cores of different sand types (as in table 3) and the depth of coating penetration measured for each coating/sand core combination. The results can be seen in FIG. 11, and show that as previously observed (in FIG. 6), the effect of sand particle size has little effect on the amount of absorption. In contrast, the amount of critical fraction affects the depth of absorption with Ex 12 and Ex 13 having greater depths of absorption than Comp Ex 6 and 7. The results are similar whether the coatings contain graphite or molochite thereby indicating that the shape of the particle i.e. morphology is less important than the level of critical fraction.

The invention claimed is:

1. A foundry coating composition comprising a liquid carrier;

a binder;

and a particulate refractory filler;

the particulate refractory filler comprising a first relatively coarse fraction having a particle size of d>38 μm and a second relatively fine fraction having a particle size of d<38 μm, wherein no more than 10% by weight or volume of the total particulate refractory filler has a particle size of 38 μm<d<53 μm and from 0 to 50% by weight or volume of the second relatively fine fraction is constituted by calcined kaolin.

2. The composition in accordance with claim 1, wherein no more than 15% of the first relatively coarse fraction has a particle size of 38 μm<d<53 μm.

3. The composition in accordance with claim 1, wherein no more than 4% of the total particulate refractory filler has a particle size of 38 μm<d<53 μm.

4. The composition in accordance with claim 1, wherein the second relatively fine fraction comprises red iron oxide (haematite) and/or yellow iron oxide.

5. The composition in accordance with claim 1, wherein from 0 to 50% of the second relatively fine fraction is constituted by a non-gel forming silicate-based mineral with lamellar morphology.

6. The composition in accordance with claim 1, wherein the ratio of the first relatively coarse fraction to the second relatively fine fraction is from 0.1 to 2.0:1.

7. The composition in accordance with claim 1, wherein the first relatively coarse fraction comprises one or more of graphite, silicate, aluminosilicate, aluminium oxide, zircon silicate, muscovite (mica), pyrophyllite, talc and micaceous iron oxide.

8. The composition in accordance with claim 1, wherein the second relatively fine fraction comprises one or more of red iron oxide (haematite), palygorskite (attapulgite), sepiolite, goethite (yellow iron oxide) and wollastonite.

9. The composition in accordance with claim 1, wherein the second relatively fine fraction comprises particles having spherical morphology and particles having rod-like morphology.

10. The composition in accordance with claim 1, wherein the second relatively fine fraction comprises at least 10% red iron oxide.

11. The composition in accordance with claim 1, wherein the second relatively fine fraction comprises calcined kaolin.

12. A process for the preparation of a coated foundry mould or core comprising providing a foundry mould or core;

applying a foundry coating composition in accordance with claim 1 to the foundry mould or core; and removing the liquid carrier.

13. A coated foundry mould or core producible by the process of claim 12.

* * * * *